United States Patent [19]

Miwa

[11] Patent Number: 5,046,343

[45] Date of Patent: Sep. 10, 1991

[54] INSERT-MOLDED CARD KEY

[75] Inventor: Takao Miwa, Tokyo, Japan

[73] Assignee: Fuki Company Ltd., Tokyo, Japan

[21] Appl. No.: 410,105

[22] Filed: Sep. 20, 1989

[30] Foreign Application Priority Data

Sep. 26, 1988 [JP] Japan ..... 63-124770[U]

[51] Int. Cl.[5] ..... A47G 29/10

[52] U.S. Cl. ..... 70/408; 16/385; 24/3 K; 206/37.1; 206/38.1; 70/456 R

[58] Field of Search ..... 24/3 K; 70/408, 456 R, 70/456 B, 457, 458; 206/37.1, 37.5, 37.4, 37.3, 38.1; 16/385, 386

[56] References Cited

U.S. PATENT DOCUMENTS

| | | | |
|---|---|---|---|
| 3,004,422 | 10/1961 | Starrett | 70/456 R |
| 3,279,513 | 10/1966 | Henderson | 70/456 R |
| 3,442,103 | 5/1969 | Le Page | 70/456 B X |
| 3,481,168 | 12/1969 | Unter | 70/458 |
| 4,297,864 | 11/1981 | Beiev | 70/456 B |
| 4,637,238 | 1/1987 | Uda et al. | 70/408 X |
| 4,677,835 | 7/1987 | Almblad | 70/458 X |
| 4,901,547 | 2/1990 | Dal Palu' | 70/458 X |
| 4,944,171 | 7/1990 | Oliana | 70/458 X |
| 4,946,030 | 8/1990 | Guridi et al. | 206/37.1 |

FOREIGN PATENT DOCUMENTS

| | | | |
|---|---|---|---|
| 1919977 | 5/1970 | Fed. Rep. of Germany | 70/395 |
| 1111627 | 11/1955 | France | 70/456 B |
| 2262178 | 9/1975 | France | 70/456 R |
| 2634634 | 2/1990 | France | 206/37.1 |
| 2031266 | 4/1980 | United Kingdom | 70/456 R |

*Primary Examiner*—Lloyd A. Gall

*Attorney, Agent, or Firm*—Colucci & Umans

[57] ABSTRACT

An insert-molded card key in which a key and a card are mutually operatively connected, the card key comprising a key wherein a key support member formed of resin and a key body formed of metal are insert-molded, a card body having a key receiving portion formed in a portion of a card for the key, and a connecting portion for connecting the key support member of the key and the card body so that they may be rotated with each other, the key being rotatable with respect to the card body and being received in the key receiving portion. There is therefore provided an insert-molded card key which has an excellent usability, is conveniently carried, can be prevented from being lost, misplaced. etc., and can be reduced in manufacturing cost.

6 Claims, 2 Drawing Sheets

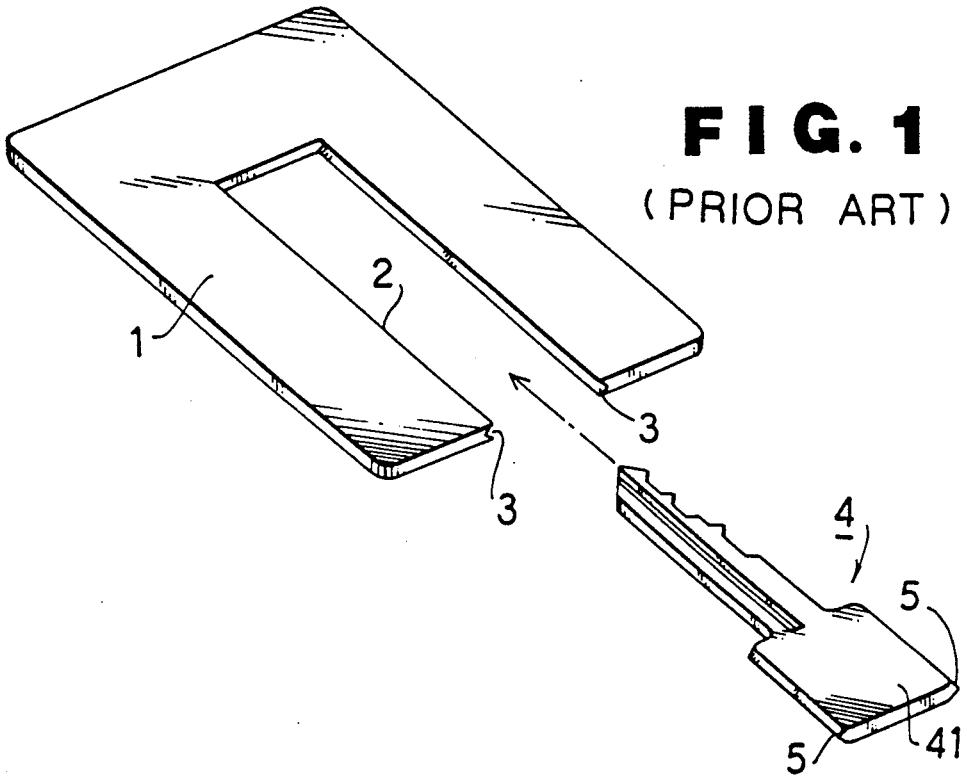
FIG. 1
(PRIOR ART)
FIG. 2 (PRIOR ART)
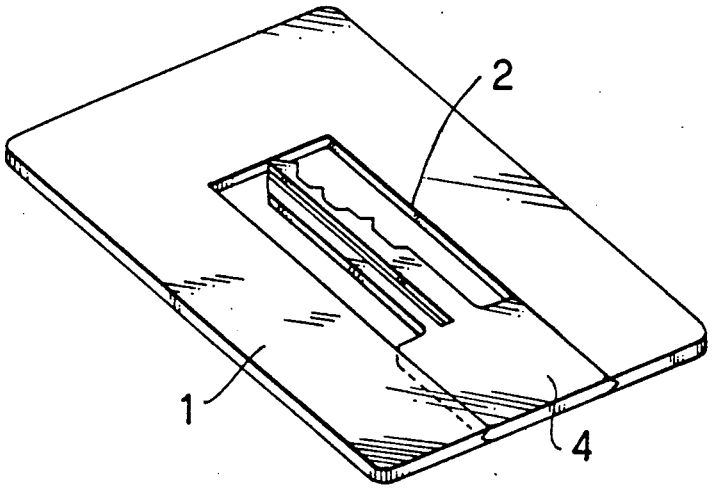

INSERT-MOLDED CARD KEY

BACKGROUND OF THE INVENTION

1. Field of the Invention

This invention relates to a portable insert-molded card key in which a key and a card-like member are operatively connected to each other.

2. Description of the Prior Art

Generally, a key is a small and simple article merely comprising a grip portion and a key portion, and a spare key merely comprising an extreme end portion of the key is carried while being put into a change purse or a key holder in case of loss of a main key or leaving it in a car. However, the aforementioned spare key is small and sometimes becomes lost. In addition, a grip portion of the key is small and grip-feeling of the key itself is bad.

On the other hand, a card key has been proposed in which a key and a card-like key support member are detachably fixed.

FIGS. 1 and 2 are respectively perspective views showing a card-like spare key shown, for example, in Japanese Utility Model Application Laid-Open Publication 101654/1988. In these figures, a card 1 has the same thickness as that of a key 4. A convex portion 5 is formed along opposite sides of a grip portion 41 of the key 4, and a rectangular portion having the same width as that of the grip portion 41 of the key 4 is cut from one side of the card 1 toward a central portion to form a concave portion along opposite sides of a cut portion 2. The concave and convex portions 3 and 5 are joined together, and the key 4 is inserted into one side (cut portion) of the card 1 so that they are positioned in one and the same plane and may be separated.

Next, a method for using the card-like spare key will be described. Normally, the concave and convex portions 3 and 5 are fitted together as shown in FIG. 2 to form a single card, which is put into a pocket or a purse. In use, the key 4 is removed from the card 1 as needed. Alternatively, a method may be employed in which the key 4 is pushed out at right angles to the card 1 to remove the concave-convex fitting portion.

In the conventional card-like key as described above, the key 4 is disengaged from the card 1 as needed, after which the key may be used independently. As the result, there was a problem that a possible loss or misplacement after disengagement of the key from the card 1 cannot be prevented.

SUMMARY OF THE INVENTION

It is an object of this invention to provide an insert-molded card key as a main key or a spare key, which does not disappear into other things and lost, which is conveniently received and carried and easily removed, and which has an excellent usability.

It is a further object of this invention to provide an insert-molded card key in which a connecting portion between a key and a card is not easily deformed or broken, the key is light-weight and the manufacturing cost thereof can be reduced.

For achieving the aforesaid objects, an insert-molded card key according to this invention comprises a key wherein a key support member formed of resin and a key body formed of metal are insert-molded, a card body having a key receiving portion formed in a portion of a card for the key, and a connecting portion for connecting the key support member of the key and the card body so that they may be rotated with each other, said key being rotatable with respect to the card body and being received in said key receiving portion.

In the insert-molded card key according to this invention, the key support member is formed of resin and is integral with the key body formed of metal by insert molding. Accordingly, the connecting portion with the card body formed on the key support member is also formed of resin, and therefore, it can be light-weight as a spare key, the connecting portion is hard to break, and the movement of the card body to the key becomes smooth.

The aforesaid and other objects and novel features of this invention will become apparent by reading the ensuing detailed description in conjunction with the accompanying drawings. The drawings are exclusively for interpretation and not to limit the scope of the invention.

BRIEF DESCRIPTION OF THE DRAWINGS

FIG. 1 is a perspective view showing a conventional card key in the state wherein a key is apart from a card;

FIG. 2 is a perspective view showing a conventional card key in the state wherein a key and a card are fitted together;

DETAILED DESCRIPTION OF THE PREFERRED EMBODIMENTS

Preferred embodiments of this invention will now be described in detail with reference to the accompanying drawings.

Figure 3:
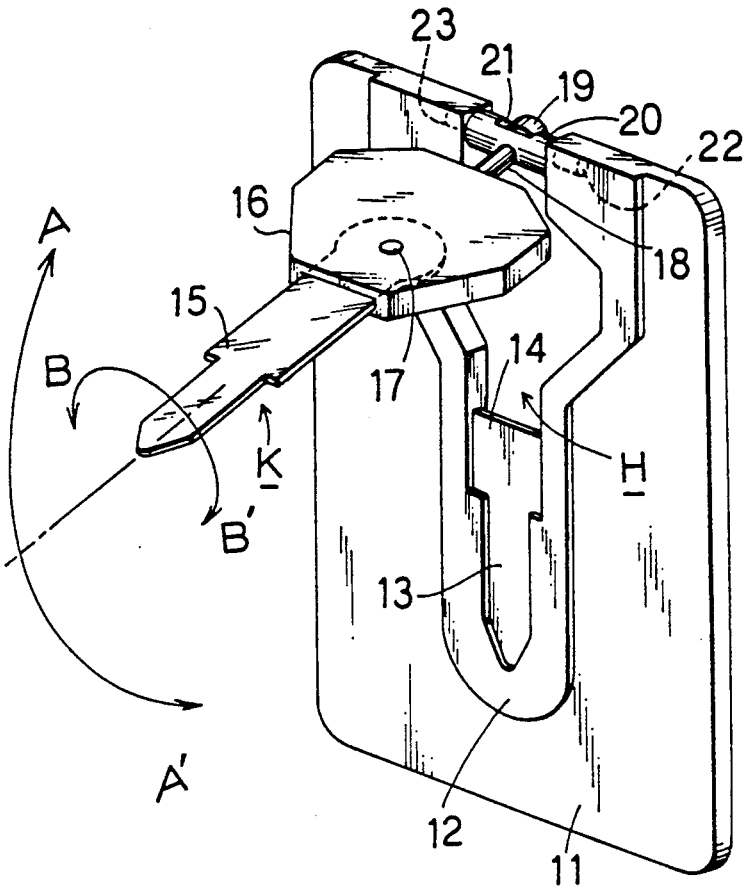
FIG. 3 is a perspective view of an insert-molded card key showing one embodiment of this invention.

FIG. 3 is a perspective view of an insert-molded card key according to this invention.

In FIG. 3 illustrates a card body 11 molded of resin. A substantially central portion 12 of the card body is formed to have a wall thickness larger than that of the remaining card body 11. The central portion 12 is formed with a key receiving portion 13 having substantially the same shape as that of the key and being concave or recessed so that the key is completely received. In this embodiment, a bottom plate 14 is formed from the central portion of the key receiving portion 13 to the extreme end so that a key body 15 is in contact with and supported on the key receiving portion 13.

Reference numeral 15 designates a key body formed of metal and 16 a key support or grip member molded of resin. The key body and the key grip member 16 are integrally formed by insert molding and thus fixed to each other. Reference numeral 17 designates a reference hole required in the case where the key body 15 and the key grip member 16 are integrally insert molded. Reference numeral 18 designates an axial pin molded on one end of the key grip member 16, and the pin is formed at the extreme end thereof with a head 19 having a larger diameter than that of the pin 18. The pin 18 and the head 19 are also molded simultaneously with the key grip members 16. Reference numeral 20 designates a connecting cross pin or member rotatably slipped over the pin 18, and a cut or notch 21 having a width somewhat larger than the head 19 and having a depth extending to a center axis is formed in the central portion of the connecting pin. Reference numerals 22 and 23 designate stop pins provided on opposite ends of the cross member or connecting pin 20, the pins being inserted into holes (not shown) formed on the side wall of the key receiving portion 13.

A cut portion H is provided to insert a finger therein from the back to easily remove the key from the plane of the card when the key K is used. In its storage position, the key, comprising key body 15 and grip member 16, are in the plane of the card.

The present invention is constructed as described above. The key K is rotated about the center axis of the connecting pin 20 which lies in the card plane and in a direction as indicated by arrow A—A' out of the plane of the card, and can be also rotated in a direction as indicated by arrow B—B' about the axis of the pin 18 and the axis of the key.

While in the present embodiment, the connecting pin 20 is also formed of resin, it is to be noted that the pin may be formed of metal, or the connecting pin 20 may be insert-molded to constitute it from resin by use of the metal stop pins 22 and 23.

Alternatively, the head 19 at the extreme end of the pin 18 may be formed into a spherical shape, and a receiving portion for slidably receiving the spherical head may be provided in the central portion of the connecting pin 20 so that both the elements may be operatively engaged.

In the embodiment of FIG. 3, connecting means are thus formed for allowing the key to pivot out from its key-shaped recess H, 13, and further in a direction around the axis of the key. The connecting means comprise the cross member 20 which is pivotally mounted about an axis lying in the plane of the card, and the axial pin 18 which is rotatably mounted to the cross member about the major axis of the key K.

Figure 4:
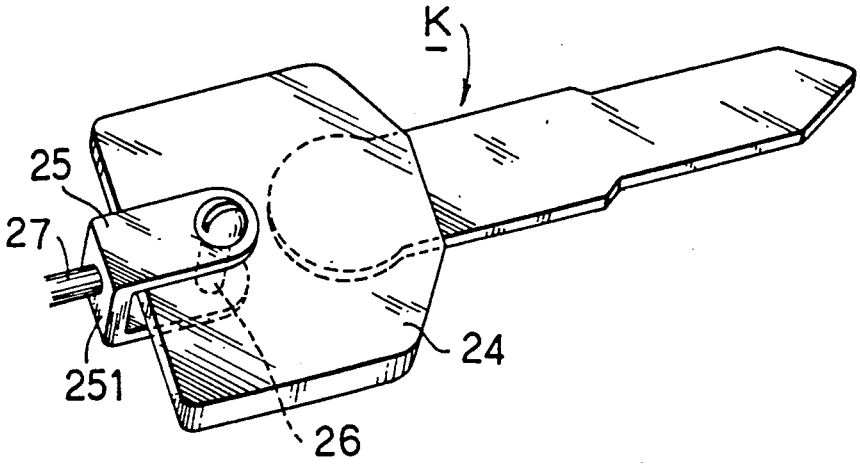
FIG. 4 is a perspective view of a connecting portion of an insert-molded card key showing the other embodiment of this invention.

FIG. 4 shows a further embodiment. A C-shaped member is provided so as to sandwich a key grip member 24 from both sides, and a pin 26 is provided to extend through the extreme end of the aforesaid member and the key grip member. A fixed pin 27 is fixedly mounted on an end 251 of the C-shaped member and rotatably engaged with a connecting pin (not shown) as shown in FIG. 3. Pin 27 and member 24 thus form the connecting means in this embodiment.

With the arrangement as described above, the key K is rotated in either direction, and therefore, operability is enhanced. In this case, the key grip or support member 24 of the key K is molded of resin, and the extreme end thereof comprises an insert-molded key formed of metal.

The insert-molded card key according to this invention is constructed as described above. Therefore, the card key can be used as a main key or a spare key, which is not disappeared in other things and lost, is very conveniently received and carried, and is easily removed without being caught by clothes or scratching the latter. Further, when the key is rotated by 180° or so about a connecting portion of a coupling as needed, it can be used as a key. Moreover, particularly the key and the card are rotatable, and therefore, the angle between the key and the card has a freedom, and the key can be rotated freely. When the key is rotated, the card is not obstructed to easily rotate the key, providing an excellent usability. Furthermore, this card key is lightweighted and portable, and the connecting portion is made of resin to render rotation of the key smooth. The connecting portion is prevented from being broken due to shocks or the like. The manufacturing cost can also be reduced. Marginal portions of the card can be utilized as advertising and information medium.

The manufacturing of this card key can be continuously effected following the manufacture of the key, and can be made by post-processing with respect to a complete key separately from the key manufacturing step.

What is claimed is:

1. An insert-molded card key comprising:

a planar card body formed of molded resin and having a key-shaped recess lying in the plane of the card body;

a key having a storage position in the key-shaped recess, the key having a plane lying in the plane of the card body in the storage position and having a major axis, the key comprising a grip member made of molded resin and a key body made of metal and integrally insert-molded with and at least partially in the grip member so that the grip member is fixedly connected to the key body; and connecting means connected between the grip member and the card body, said connecting means permitting the key to be moved into a use position out of the plane of the card body and out of the key-shaped recess, the connecting means further permitting rotation of the key about the major axis of the key, the connecting means comprising a C-shaped member connected to the grip member and movably connected to the card body.

2. An insert-molded card key comprising:

a planar card body formed of molded resin and having a key-shaped recess lying in the plane of the card body;

a key having a storage position in the key-shaped recess, the key having a plane lying in the plane of the card body in the storage position and having a major axis, the key comprising a grip member made of molded resin and a key body made of metal and integrally insert-molded with and at least partially in the grip member so that the grip member is fixedly connected to the key body; and connecting means connected between the grip member and the card body, said connecting means permitting the key to be moved into a use position out of the plane of the card body and out of the key-shaped recess, the connecting means further permitting rotation of the key about the major axis of the key, the connecting means comprising a cross member mounted to the card body at an end of the key-shaped recess, and an axial pin fixed to the grip member and rotatably mounted to the cross member, the cross member being pivotally mounted to the card body about an axis lying in the plane of the card body.

3. An insert-molded card body key according to claim 2 wherein the cross member comprise a cross pin having a hole therethrough, the axial pin extending through the hole and having an enlarged head on an end of the axial pin opposite from the grip member for retaining the axial pin in the hole.

4. An insert-molded card body key according to claim 3 wherein the cross pin includes a recess for at least partly receiving the head of the axial pin.

5. An insert-molded card body key according to claim 4 wherein the card body includes a thick central portion containing the key-shaped recess, and a remaining thinner portion of the card body connected to the central portion.

6. An insert-molded card body key according to claim 5 including a bottom plate extending in a portion of the key-shaped recess for receiving the metal key body and for engagement with the metal key body to hold the key in its storage position.

* * * * *